US005337126A

United States Patent [19]

Michlin

[11] Patent Number: 5,337,126

[45] Date of Patent: Aug. 9, 1994

[54] COPIER AND PRINTER TONER SHIPPING, HANDLING AND SEALING SYSTEMS

[76] Inventor: Steven B. Michlin, 5310 Bentley Ste. 105, West Bloomfield, Mich. 48322

[21] Appl. No.: 100,925

[22] Filed: Aug. 3, 1993

[51] Int. Cl.[5] ..... G03G 15/06

[52] U.S. Cl. ..... 355/260; 222/DIG. 1

[58] Field of Search ..... 355/245, 260; 222/DIG. 1; 141/114, 329; 206/222, 532

[56] References Cited

U.S. PATENT DOCUMENTS

| | | | |
|---|---|---|---|
| 4,417,802 | 11/1983 | Forbes, II | 355/260 |
| 5,075,727 | 12/1991 | Nakatomi | 355/260 |
| 5,079,591 | 1/1992 | Tomita et al. | 355/260 |

FOREIGN PATENT DOCUMENTS

| | | | |
|---|---|---|---|
| 0168469 | 9/1984 | Japan | 355/260 |
| 0098469 | 6/1985 | Japan | 355/260 |
| 0144770 | 7/1985 | Japan | 355/260 |
| 0115874 | 4/1990 | Japan | 355/260 |
| 0264573 | 9/1992 | Japan | 355/260 |

*Primary Examiner*—A. T. Grimley
*Assistant Examiner*—William J. Royer

[57] ABSTRACT

A toner delivering apparatus and method for supplying toner to the toner hoppers of toner cartridges used in printer, copier and facsimile machines. In one embodiment a balloon is filled with toner. A string or wire is wrapped aroound the center of the balloon. The balloon is sealed in a toner hopper, with the balloon attached to the inside walls of the hopper and a free end of the string or wire tied or otherwise secured to the toner lumping-prevention paddle. When the toner cartridge is loaded in the machine and operated, the paddle rotates, pulling and tightening the string or wire around the balloon. The balloon breaks or tears, releasing toner evenly along thelength of the toner hopper. In another embodiment, a plastic, cellophane-like material is used for the toner packaging. A pull-tear strip extends along the package and is also attached to the paddle. When the paddle rotates, the pull-tear strip is removed from the package, opening the package and distributing toner within the toner hopper. For toner hoppers which do not use rotating paddles to prevent toner lumping, a small opening is provided in the hopper above the expected level of toner. The pull-tear strip extends through this opening so the toner package may be opened from outside the hopper. The user pulls the strip and does not come into contact with the toner.

16 Claims, 12 Drawing Sheets

COPIER AND PRINTER TONER SHIPPING, HANDLING AND SEALING SYSTEMS

BACKGROUND OF THE INVENTION

A major problem in the dry toner imaging industry is the shipping of toner powder in specific weight increments to the user or toner cartridge remanufacturer. The remanufacturer normally receives toner in bottles. The bottles are usually made of plastic. These bottles and caps generally cost a lot of money and wind up in landfills after the bottles are used. Upon receiving these toner bottles, many remanufacturers normally "funnel" the toner into the toner hopper component of the toner cartridge. In so doing, much dust gets generated in the air, contributing greatly to the dust problem associated with a typical toner cartridge remanufacturing facility.

Cheap, abundant, plastic orange juice bottles are also used in the industry to contain and ship toner. One company uses milk cartons for packaging toner. Paper "pouches" have also been used. To use one of these pouches, a corner of the pouch is cut off and then the toner is poured through a funnel into the toner hopper. This cumbersome method generates a lot of dust in the funnelling process.

It is customary for the manufacturer of a printer or copying machine to fill the toner hopper with dry toner, and seal the opening of the toner hopper with a plastic sheet attached on the sides of the hopper and on each end of the hopper, just prior to assembling the toner hopper with the other components of a toner cartridge unit. When the toner cartridge is received at the using location, the seal is removed from the toner hopper section of the cartridge, and the printer or copier is ready for use, with the toner being exposed to the roller feed device for making copies. A problem with this is that when the enduser pulls this plastic sheet seal to remove it from the toner hopper, the seal is soiled on one side and some toner dust spills out. Consequently, the enduser may get toner on his hands, clothes, and all over the work area.

Recent developments in the dry toner imaging industry have led to the use of "throw-away" type toner cartridges, whereby the user of the copier or printer must buy a new, filled, toner cartridge from the manufacturer when the original toner hopper in the toner cartridge is depleted of toner. This method of throw-away toner cartridges is very expensive to the user of the copier or printer as a new cartridge is required each time the toner in the toner cartridge's toner hopper is depleted. The toner is expensive enough, but to add the expense of a new cartridge, with its toner dispensing means, adds a substantial amount of cost to the replacement procedure.

It has been customary in the past to throw away these very expensive, empty toner cartridges, and replace them with new, filled, and sealed factory toner cartridges. The manufacturers seal the toner hopper components in these new toner cartridges at their manufacturing location, and there is no leakage of the toner during shipment. This type of operation, using expensive throw-away cartridges, has therefore led to the need for a method and apparatus for re-filling, re-sealing, shipping, and re-using these toner cartridges, with the obvious savings of the cost of the new toner cartridge, in addition to the benefits of avoiding disposal and environmental problems. A device which attempts to meet this need must take into account that any leakage of dry toner from the toner cartridge is a major cleaning problem at best, and may cause severe soiling damage to the surrounding environment, in the normal accident, as well as damage to the equipment.

One product for re-sealing the dry toner hopper when refilling uses a plastic sheet, which slides into the slot in the toner hopper section of the toner cartridge created when the original seal is removed.

Another product for re-sealing the dry toner in the re-filled hopper uses a plastic sheet with a magnetic coating, to try to keep the dry toner from spilling during shipment to the user. Still others try to duplicate the factory method which may require disassembly and modification of the toner hopper and thorough cleaning of the seal-grooves.

These products do not provide good seals for various reasons and cannot be used with different types of toner hopper slots or openings. An invention was disclosed to solve toner leakage problems in applicant's U.S. Pat. No. 5,184,182, granted Feb. 2, 1993. Three thin, flat, plastic or steel rectangles were made to form a seal-insert. Two were identical rectangles with a longitudinal centerline slot cut out for the purpose of allowing toner to fall through. These two rectangles sandwiched the third rectangle between them. The third rectangle had a similar slot however, which was open at one end. These three rectangles were pressed firmly together and sealed together to form a one piece seal-insert unit with an open longitudinal centerline slot. The middle rectangle's open-ended slot allowed a slide-seal to be inserted and removed. The seal-insert was intended for permanent insertion into a toner hopper. When the slide-seal, consisting of a stiff strip, slid into the slot of the middle rectangle, a seal was achieved so that toner powder could not leak out and the toner hopper could be shipped from one location to another.

But this seal, like the others, is not universal. Some toner hoppers do not have slots for receiving such seals. Additionally, prior seals fail to address the problem of toner distribution in pre-weighed amounts to the toner cartridge manufacturer/remanufacturer. Prior seals do not solve the problems of toner mess and litter by-products created when toner cartridge hoppers are refilled.

This invention relates to an apparatus for providing a way to seal and re-seal the toner hoppers of expensive toner cartridge used in dry toner printing, copying and facsimile machines. As a result, the toner cartridge may be shipped from one location to another without leakage of toner. The invention allows for shipping of pre-weighed amounts of toner and cleaner handling of the toner.

Accordingly, it is an object of this invention to provide an apparatus and method for refilling and re-sealing the toner hoppers of toner cartridges.

Another object of this invention is to enable pre-weighed amounts of toner to be used in the above method, without the need for pouring toner from a package device into a toner hopper.

A further object of this invention is to provide a clean toner handling and shipping system that may be made to fit into most types of toner hoppers.

Still another object of this invention is to provide a toner packaging device which is opened and emptied only upon operation of the toner cartridge in the printing, copying or facsimile machine.

In carrying out this invention in the illustrative embodiment thereof, a package such as a balloon or plastic bag is pre-filled with the required amount of toner by the toner bottler, and then shipped to the cartridge remanufacturer. The cartridge remanufacturer places the unopen package in the toner hopper of a toner cartridge. Either the package or a toner releasing device on the package is attached to a rotating component within the hopper, such as a conventional paddle used to prevent toner lumping within the hopper. When the user receives the refilled toner cartridge from the remanufacturer, the user simply loads the cartridge into the printing, copying or facsimile machine. When the machine is operated, the toner package is broken or opened by the rotating component, and toner is equally distributed along the length of the toner hopper.

BRIEF DESCRIPTION OF THE DRAWINGS

This invention, together with other objects, features, aspects, and advantages thereof, will be more clearly understood from the following description, considered in conjunction with the accompanying drawings.

COMPLETE DESCRIPTION OF THE PREFERRED EMBODIMENT

Figure 1:
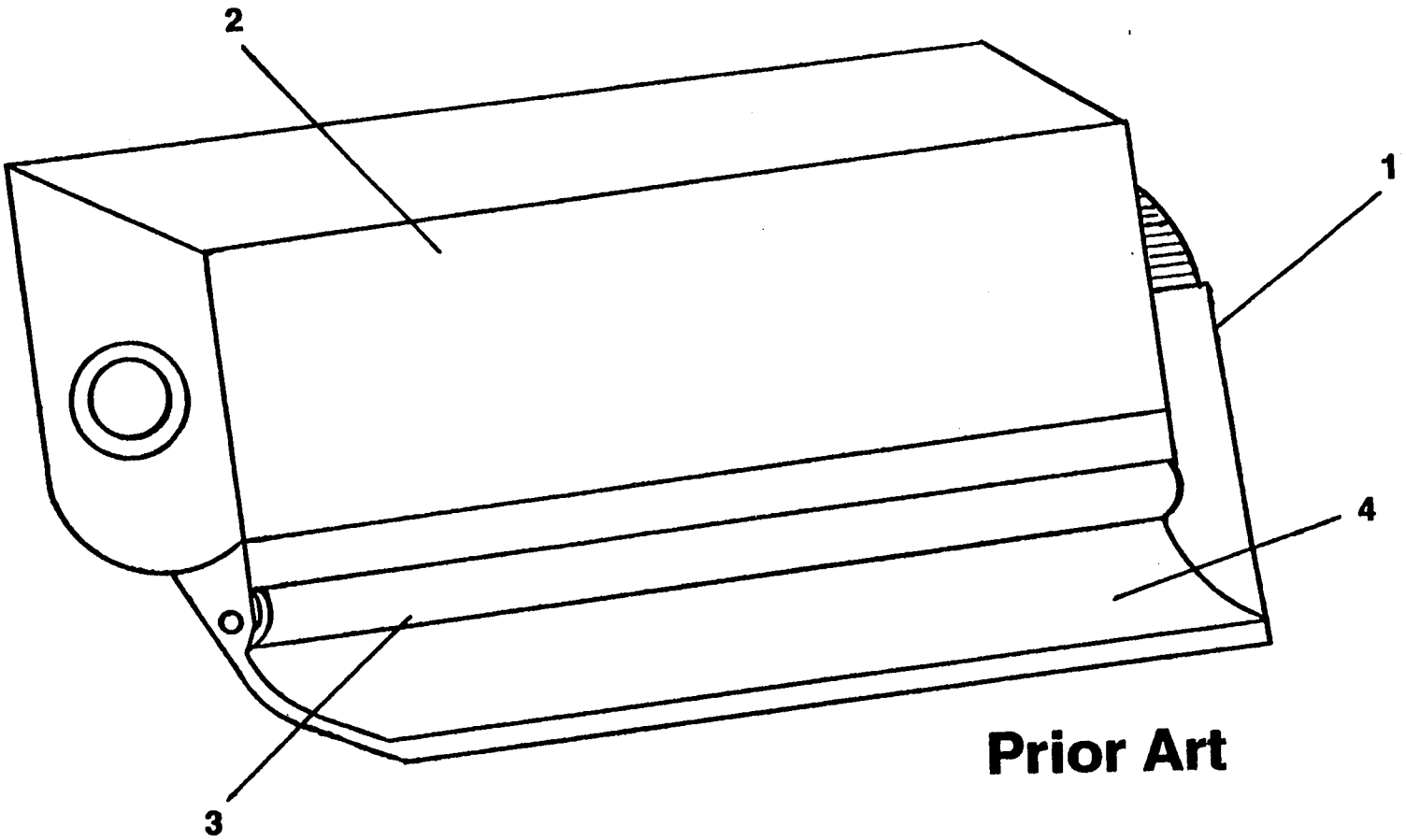
Prior Art Figure 1
FIG. 1 shows a conventional toner cartridge.

Referring now to FIG. 1, a conventional toner cartridge 1 with a toner hopper 2 is to be filled with a new supply of dry toner and sealed, thus eliminating the need to discard the expensive toner cartridge and replace it with a new one when the original supply of toner is depleted. In this invention, applicant is referring to the type of toner hopper comprising a toner receptacle in a toner cartridge. Generally, toner cartridges are designed to be a shippable, expendable component of laser printers, copier and facsimile machines. The toner cartridge not only contains the supply of toner but also has moving components to deliver the toner to the developing roller of the machine.

In the toner cartridge 1 of FIG. 1, the toner hopper 2 provides toner to a pre-feed roller 3. The pre-feed roller 3 dispenses dry toner from the hopper 3 to the feed roller (not shown) in the feed roller provision 4, where the toner is then delivered from the cartridge 1 to the other components in the copying or printing process.

Figure 2:
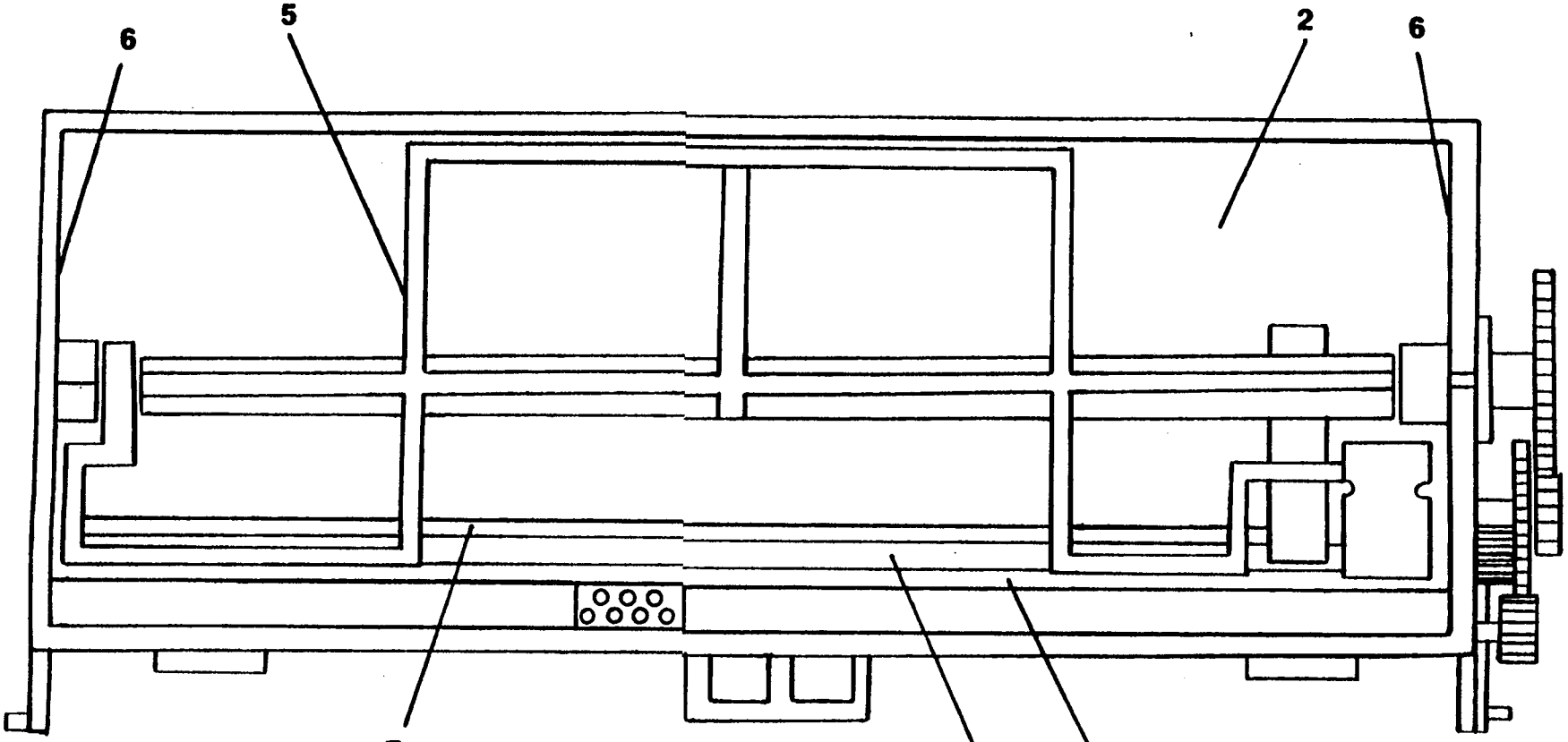
Figure 2 Prior Art
FIG 2 is a top view of the toner cartridge of FIG. 1 with a wall removed to show the inside of the toner hopper.

FIG. 2 is a top view of FIG. 1 with a toner hopper wall removed to show the inner part of the hopper 2. In this particular type of toner cartridge 1, the toner hopper includes a rotating paddle 5 extending between the ends 6 of the hopper 2. The paddle 5 rotates when the toner cartridge is operating within the printer, copier or facsimile machine to keep the toner from lumping or caking within the hopper 2, allowing the toner to be evenly and efficiently dispensed. Two mylar strips 7 form an opening 8 in the bottom of the hopper 2. This opening 8 is blocked by the pre-feed roller 3 so toner does not simply fall out of the hopper 2, but is dispensed to the feed roller by the pre-feed roller 3. However, during shipping and handling toner can leak out of the opening 8 around the pre-feed roller 3. When brand new, there is no sealing means. Some remanufacturers use an adhesive strip over the opening 8 to prevent toner leakage in the toner hopper. When the remanufactured toner cartridge 1 is first used, the paddle 5 catches the adhesive strip and removes it from the opening. The strip wraps around the paddle 5 and remains there. Besides the fact that the adhesive strip cannot be reapplied over the opening 8 before the toner hopper 2 is refilled with toner, it is a poor seal.

Figure 3:
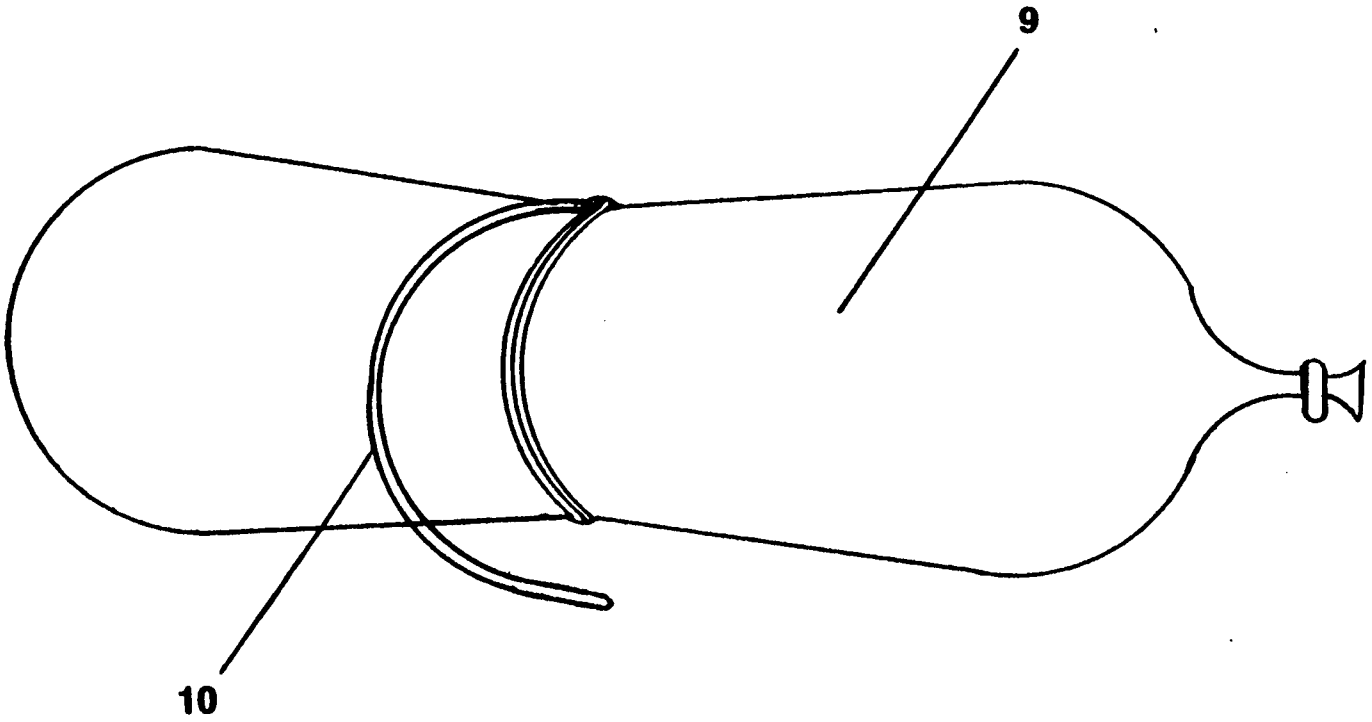
FIG. 3 shows the first embodiment of the invention, comprising a balloon filled with toner and including a toner releasing device.

FIG. 3 shows a first embodiment of this invention. It should be noted that other, similar containers may be used, but a balloon 9 will be used in this initial description. The balloon 9 is filled with toner by the toner bottler. The balloon 9 is sized to fit in the particular toner hopper to be refilled. The balloon is closed by conventional means and shipped. The cartridge remanufacturer, upon receipt of the balloon, wraps or ties a string or wire 10 around the center of the balloon 9. The balloon 9 is placed in the toner hopper 2 and attached to the hopper 2 at the hopper ends 6. The attachment may be by glue, tape, velcro, or other suitable means. The ends may be tied or pinch-tied to the balloon and the string or wire (not shown) may be tied to the hopper, taped to the hopper or somehow attached to the hopper. The string or wire 10 is tied to the paddle 5 in the hopper 2.

When the user receives the refilled toner cartridge 1, the user simply loads the cartridge into the printer, copier or facsimile machine. When the machine is operated, the paddle 5 rotates and the string or wire 10 is tightened further on the balloon's center. As the string or wire 10 continues to wrap around the paddle 5, the balloon 9 splits, rips or tears in the center, distributing the toner in the hopper 2 starting from the middle and spreading the toner towards the ends 6 of the hopper. Because of the location of the tear in the balloon 9 and the further action of the paddle 5, the toner is equally distributed along the length of the toner hopper so it may be evenly dispensed from the hopper 2 to the pre-feed roller 3. The balloon 9 and string or wire 10 wrap around the paddle 5 and may actually help the paddle 5 keep the toner from lumping or caking.

Modifications to this embodiment are possible. Of course, the balloon 9 could be attached to the paddle 5 and the wire or string 10 fastened to the toner hopper wall or other immovable object within the toner hopper 2 with the same end result. Other containing materials may be used in place of the balloon 9. For example, plastic bags, antistatic bags, latex surgical gloves, or bags with a perforation along the desired tear-area may be used. It is also possible for the paddle 5 to break the balloon 9 without the use of the wire or string 10 by simply pinching the balloon 9 against the wall of the hopper 2 or wrapping the balloon 9 around the paddle 5 until the balloon 9 is stretched to the breaking point. But it has been found that the described embodiment works well and has the added benefit of equally distributing the toner along the length of the hopper 2.

By filling toner into a balloon instead of a bottle, there is great savings to the toner bottling company because the balloon device is much cheaper than a bottle and cap. A balloon costs pennies and a bottle and cap costs twenty-five cents to one dollar, depending on the size. The relative cost savings makes this invention significant in a high volume industry. Alternately, the balloon may tear a different way. If the hopper had a razor blade in it, the balloon could be cut after it rotates to the razor blade. Some care would have to be taken in this embodiment because a shipped cartridge could be treated roughly and bounced around to the point that the balloon could hit the razor blade or sharp edge and prematurely release the toner. This potential problem could be avoided by keeping the balloon around one half paddle rotation away from the sharp blade, knife, puncture device, nail, or razor blade.

Another feature may be introduced to this system, a very important feature. When a cartridge remanufacturer remanufactures a toner cartridge, in the normal case, the remanufacturer places a small amount of toner, approximately one teaspoonful, that is equally spread along the developer roller. This allows the remanufacturer to test the toner cartridge in an actual copier or laser printer. Test sheets may be printed, even though the toner is sealed, unavailable to the developer roller.

This may be accomplished with the balloon system as well. However, with the balloon system, only a limited number of pages may be printed before the balloon will tear. By having a limited, yet measured amount of slack or excess string or wire 10, some test sheets may be generated in order to "quality control" test the cartridge. However, doing so has the problem of limiting the number of test sheets. If the remanufacturer, when quality control testing the toner cartridge, prints too many pages, he will cause the balloon to tear while testing and, thus, will break the sealed toner prematurely. It is possible that future printer manufacturers, if licensed to use this invention, may not only design their toner cartridges around this invention, but may also design their printers around this invention. For example, there will be an "initialize" mode on the control panel of the printer that will print 1–20 pages, or more, for the purposes of rotating the paddle enough to break the seal and pop the balloon.

Figure 4:
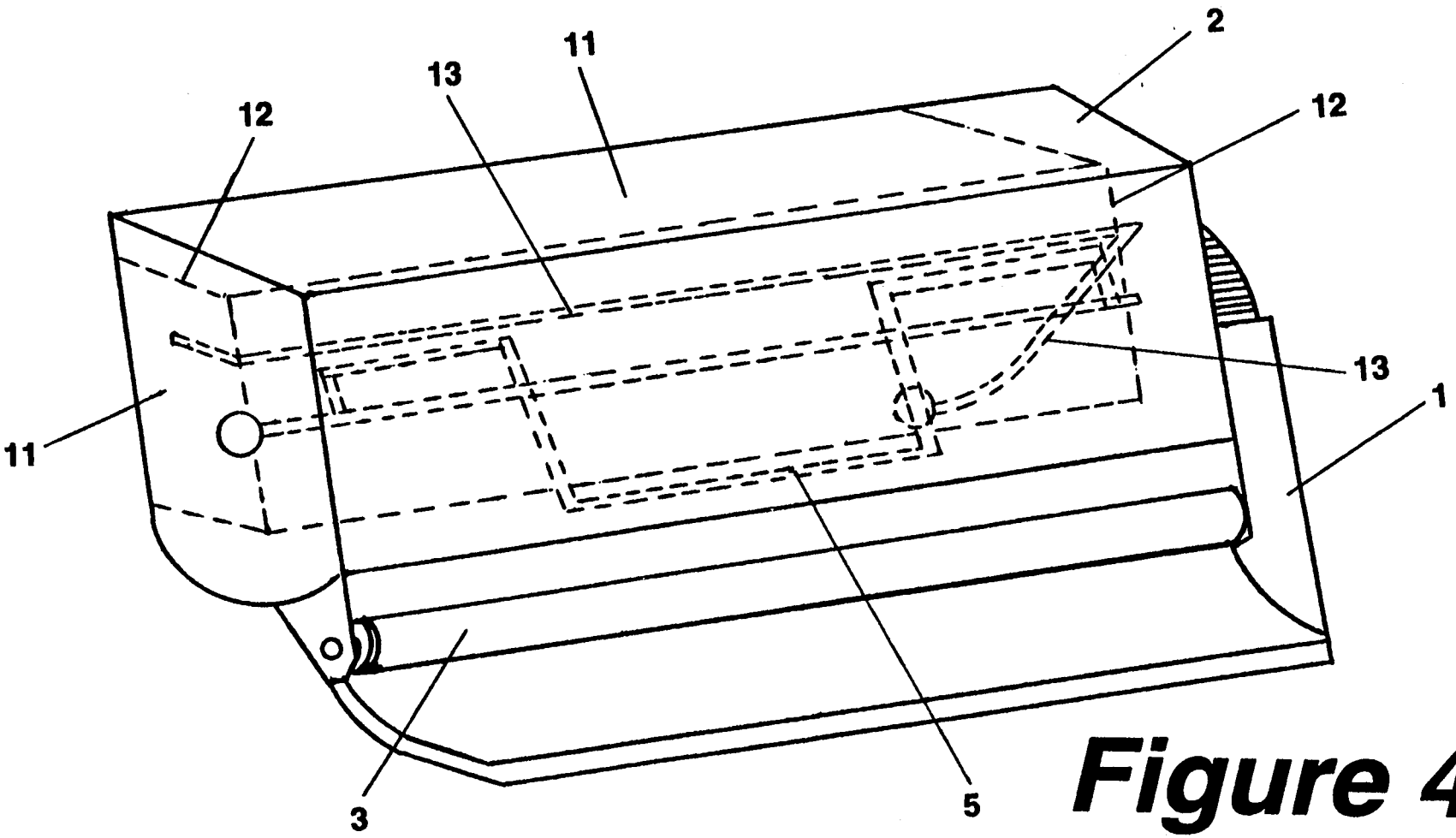
FIG. 4 shows a second embodiment of the invention, comprising a different type of toner package inserted in the toner hopper.
Figure 5A:
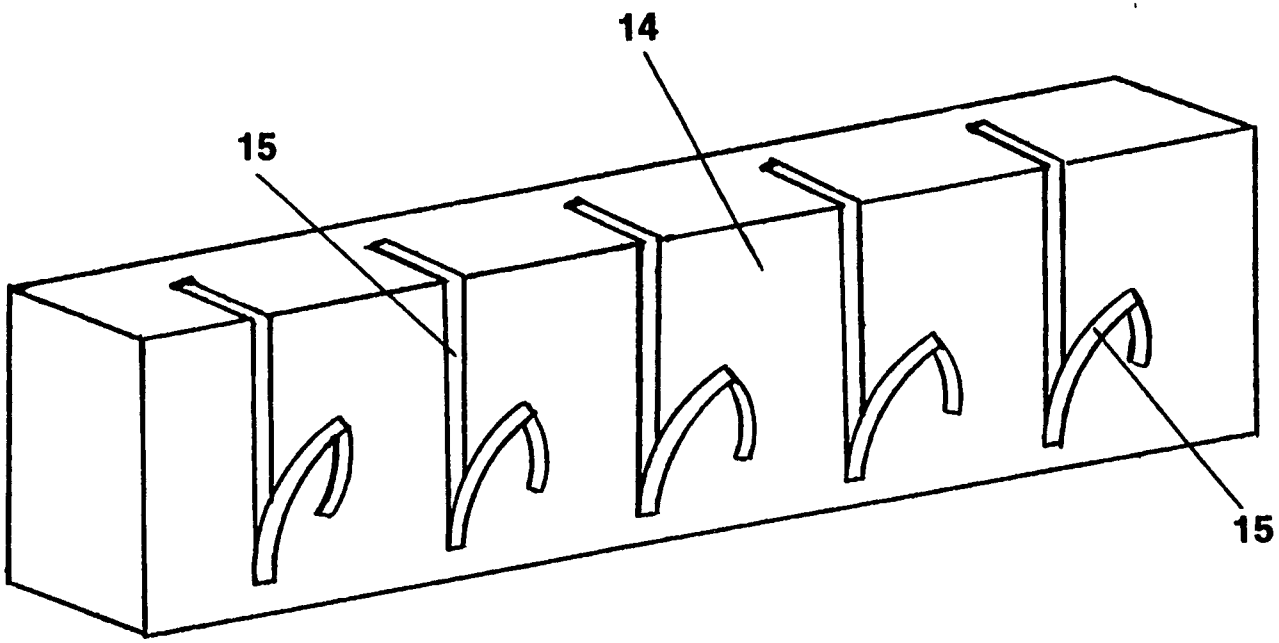
FIGS. 5*a* through 5*e* show modifications to the package of FIG. 4.
Figure 5B:
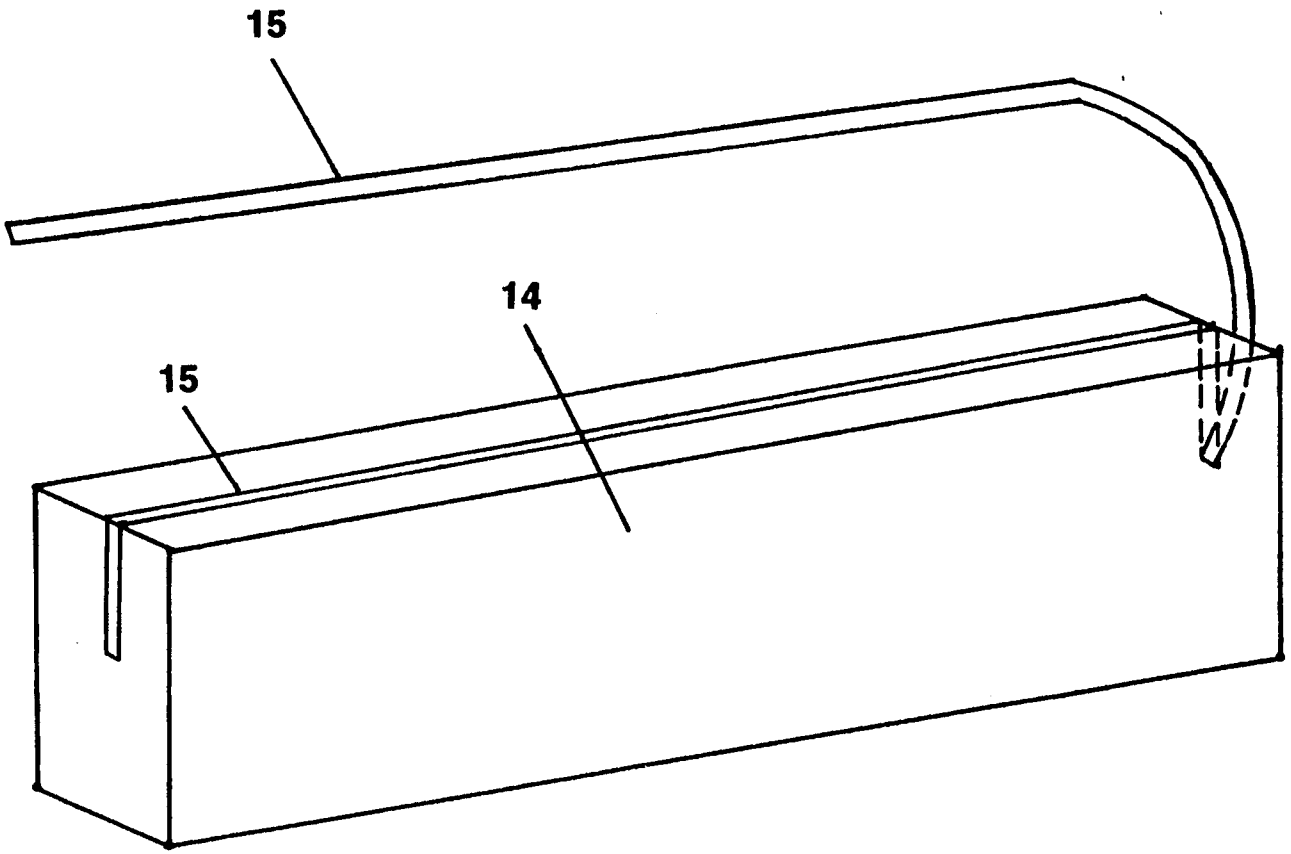
Figure 5C:
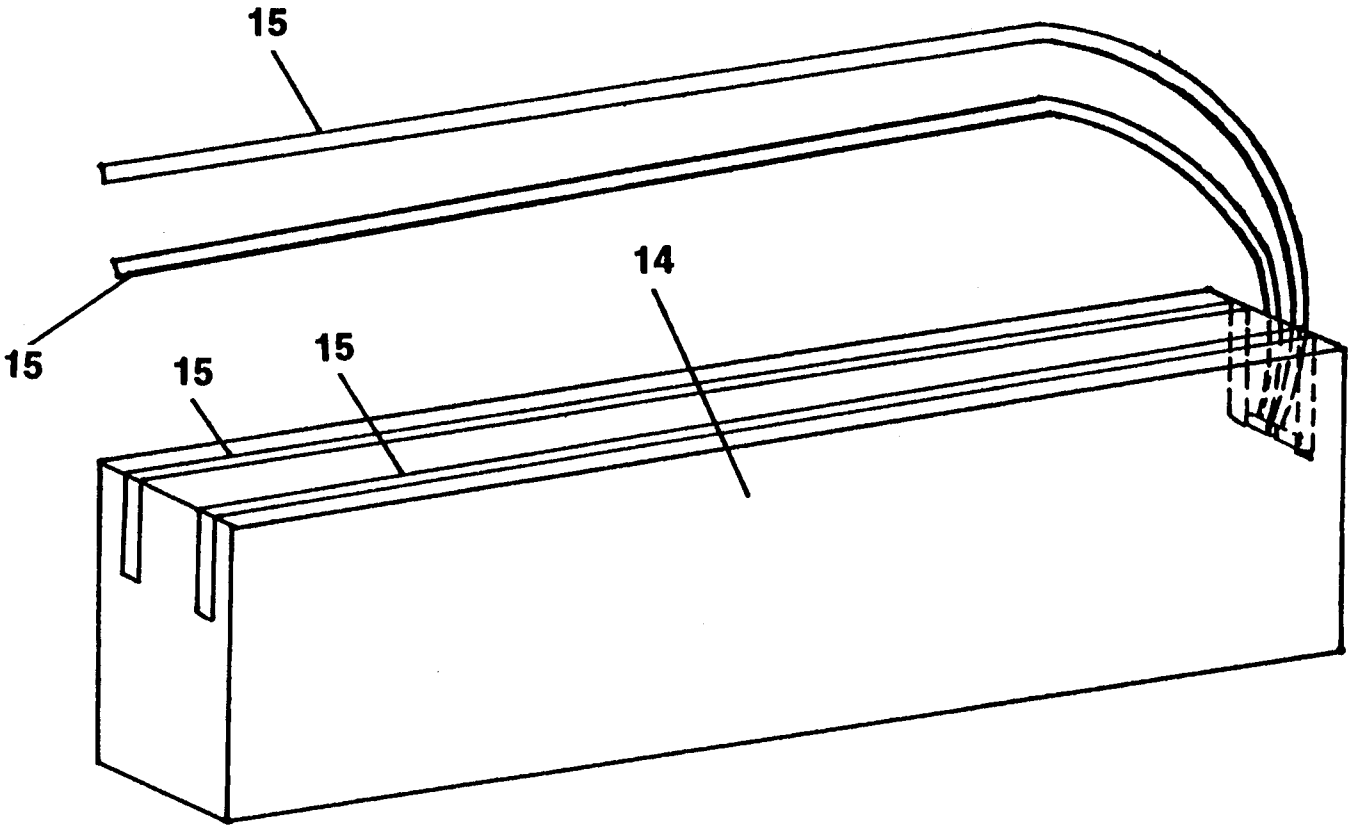
Figure 5D:
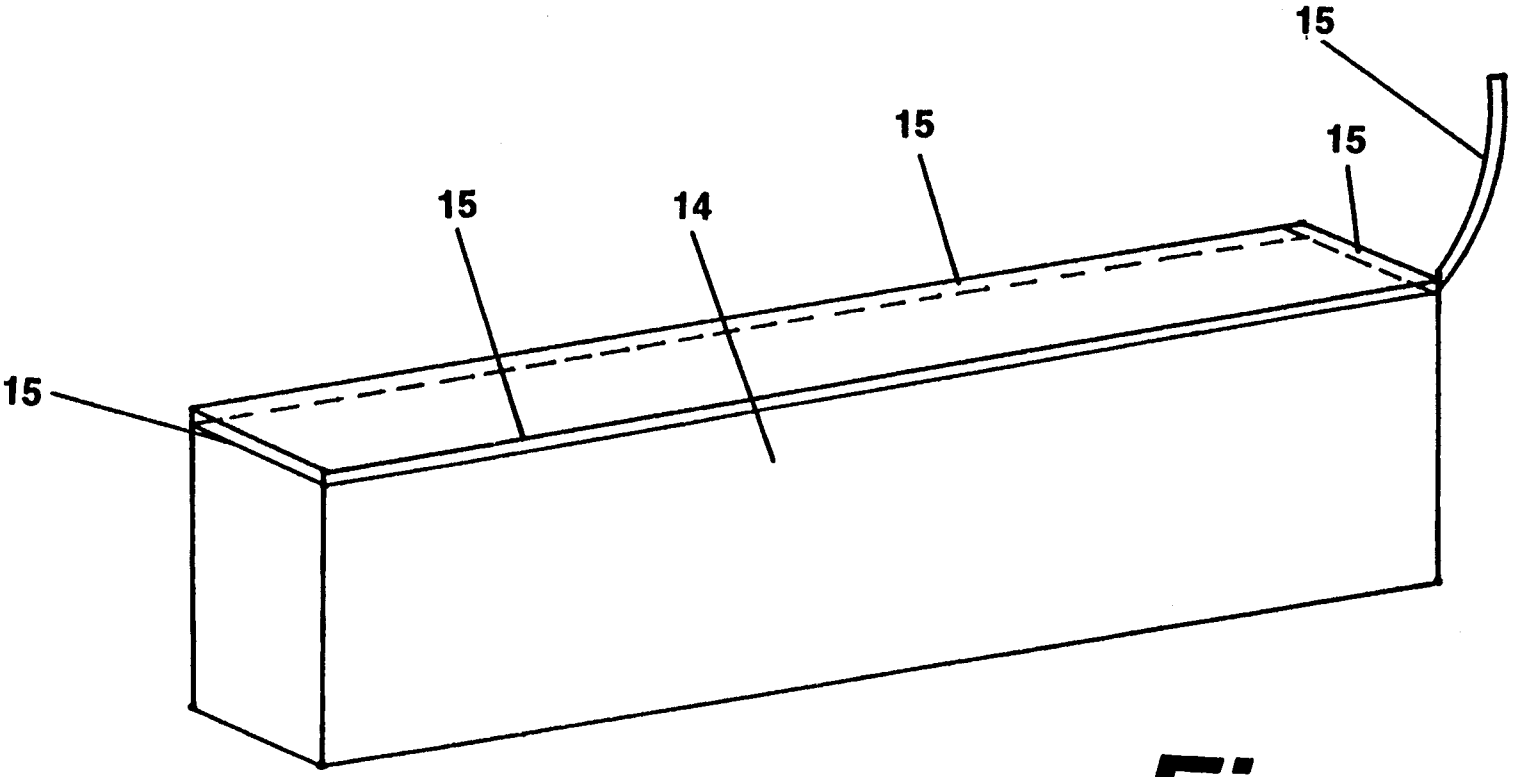
Figure 5E:
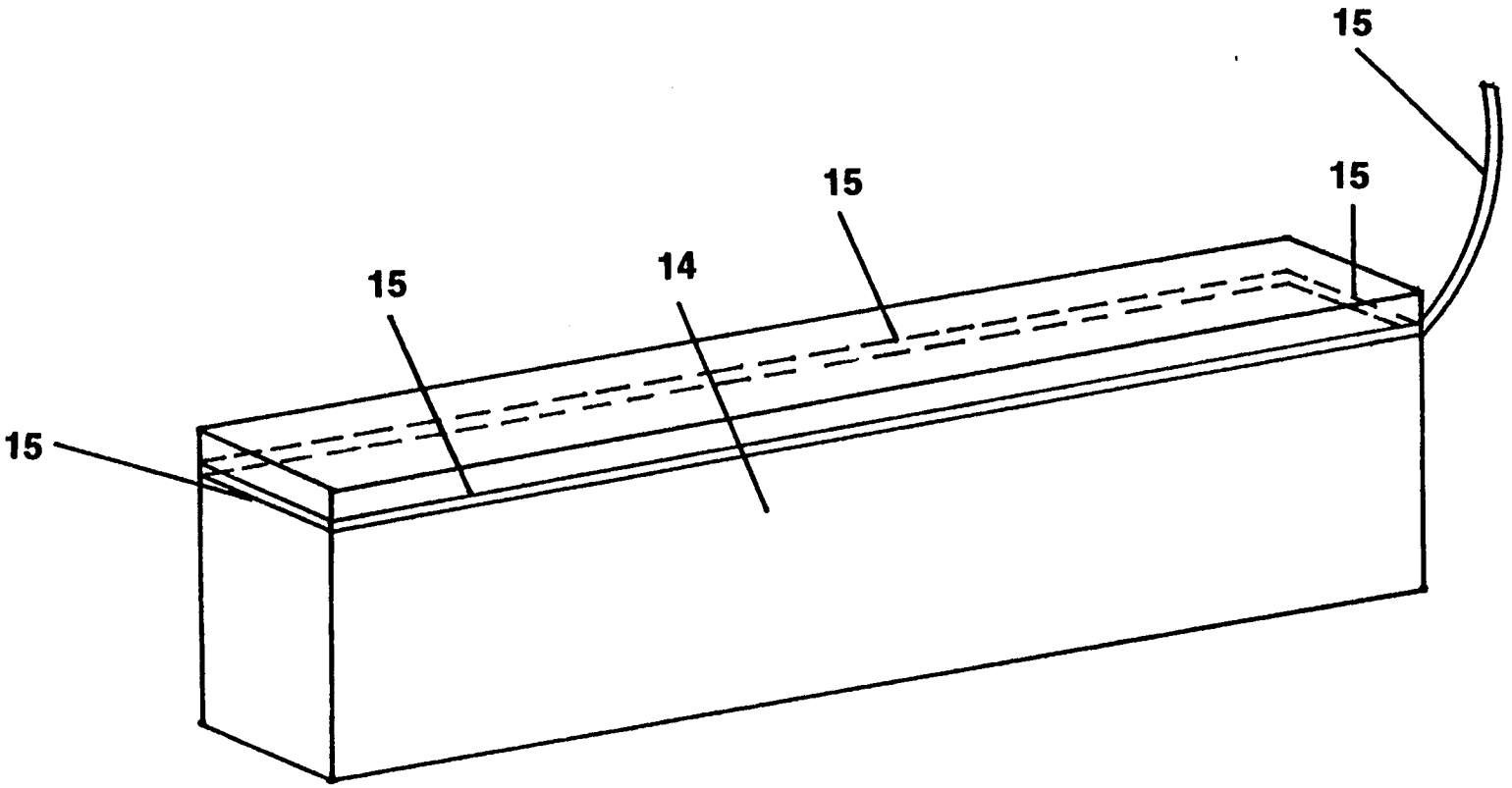

In another embodiment, a plastic cellophane-like material, such as that used in cigarette packages or for packaging videocassettes, may be used to contain the toner. These packages use a pull-tear strip to control where the plastic gets torn. FIG. 4 shows one example of how the toner cartridge 1 can make use of this type of packaging. The plastic bag 11 containing the toner 1 is fastened or tied at its ends 12 within the toner hopper 2. Glue, tape, velcro, hot melt glue, or other suitable means could be used to secure the package 11 to the hopper 2. Then the pull-tear strip 13 is attached to the rotating paddle 5, by tape, velcro, glue or other suitable means. Conversely, the plastic bag 11 could be attached to the paddle 5 and the pull-tear strip 13 fixed to the toner hopper 2 or a special holder made for it within the hopper. With this embodiment, the pull-tear strip 13 would extend along the length of the toner bag 11, so the toner distribution will be even or equal along the length of the toner hopper 2. As the paddle 5 rotates, in the case of FIG. 4 the paddle 5 would slowly wind up the pull-tear strip 13, tearing it off the bag 11, opening the bag 11 and releasing the toner along the length of the toner hopper 2. When the pull-tear strip 13 is finally completely torn off the toner package, it winds loosely around the paddle 5. This winding prevents the pull-tear strip 13 from being dispensed from the hopper 2 and eventually tangling up in the developer roller.

FIGS. 5*a* through 5*e* show similar types of packages 14, which may be made of a plastic cellophane-like material or actually cellophane. In this adaptation, there are multiple pull-tear strips 15 for attachment to the paddle 5 or hopper 2. These pull-tear strips 15 allow the package or container 14 of toner to be opened at different locations along its length, insuring that the package 14 is completely emptied of toner when the toner cartridge 1 is operated and providing for equal distribution along the length of the toner hopper 2. The pull-tear strips 15 could be in any orientation on the package 14, including parallel to the length of the package.

Figure 6A:
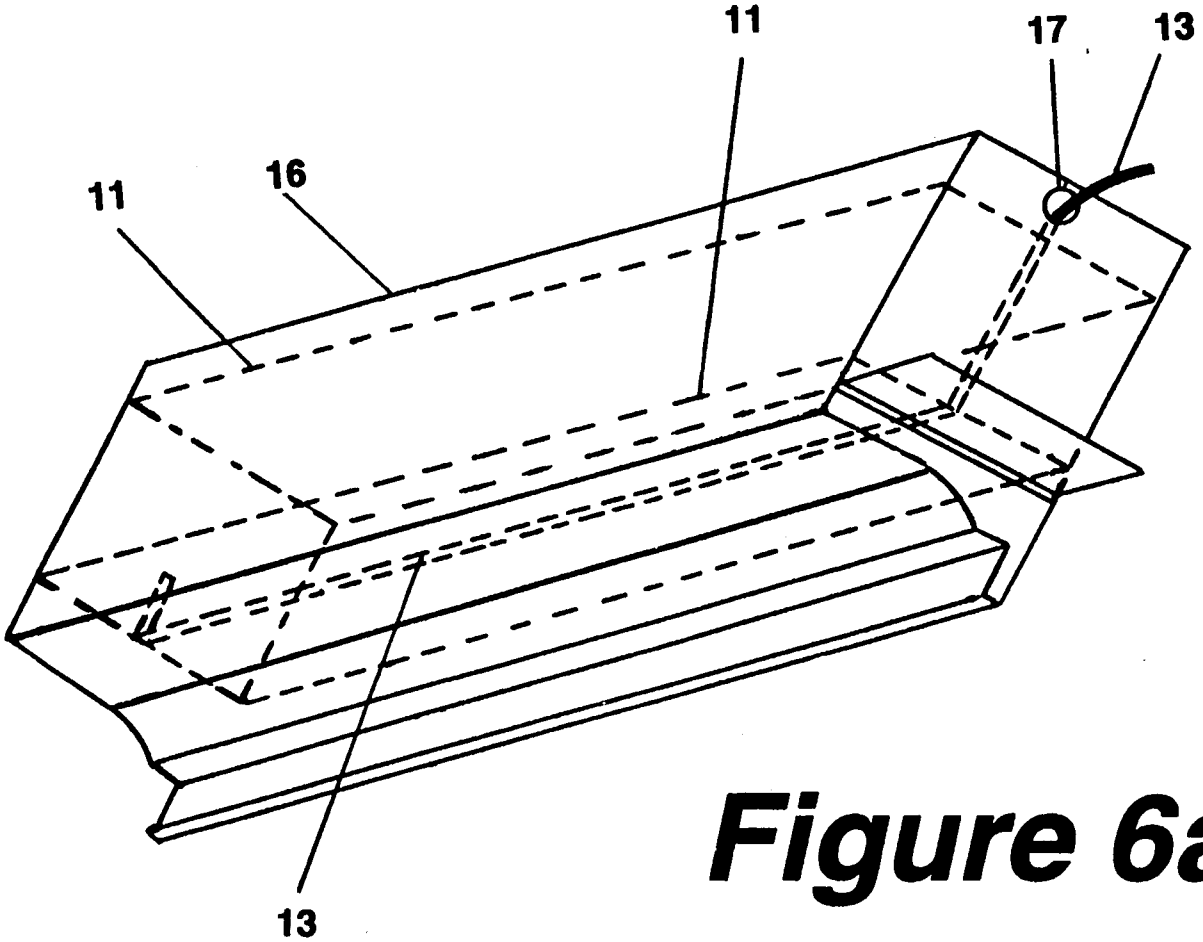
FIGS. 6*a* through 6*c* show different types of toner hopper modifications to make use of a toner package of the invention.
Figure 6B:
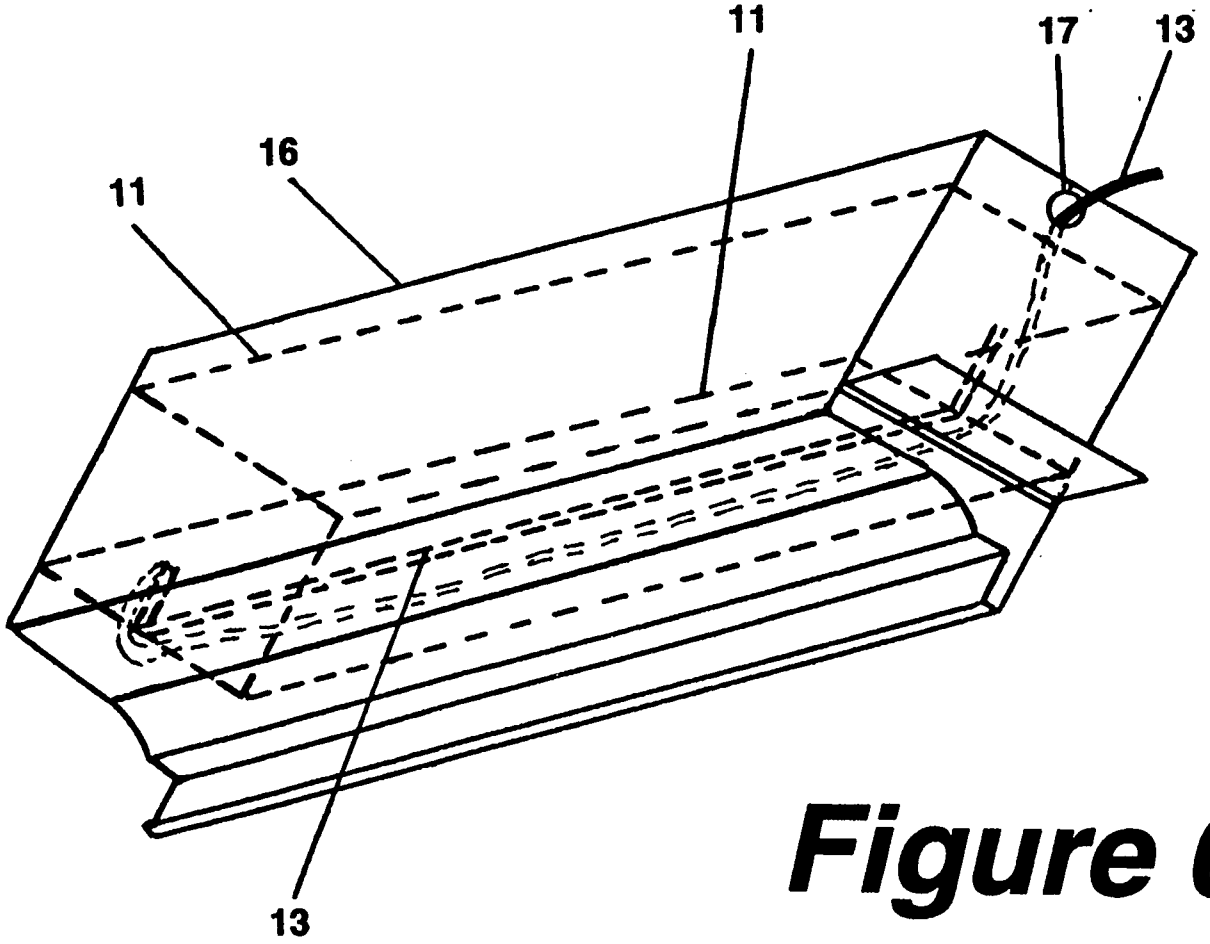
Figure 6C:
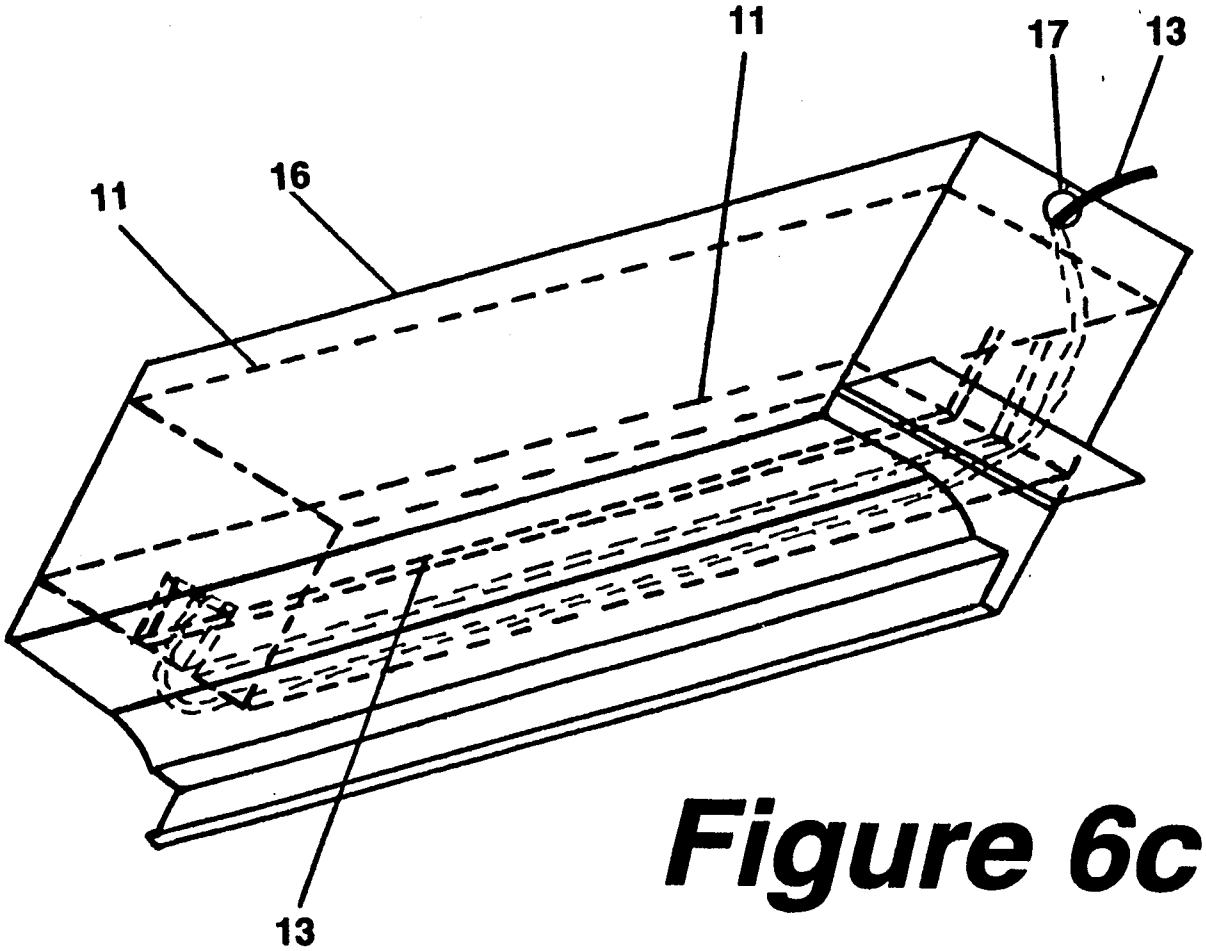

It should be noted that not all brands of toner cartridges have rotating or reciprocating paddles in their toner hoppers. In some hoppers, the toner simply falls by gravity. FIGS. 6*a* through 6*c* show these types of hoppers 16. In such cases, other moving or rotating components within the hopper or cartridge must be used to open the toner package by winding up the pull-tear strip 13. If none of these components are present, an opening 17 could be drilled, cut or otherwise made in a wall of the toner hopper 16 above the expected toner level with a tight foam cover (not shown) with a slot acting as a check-valve. The end of the pull-tear strip 13, for example, would extend through this opening 17 so when the toner cartridge is ready to be used in the printer, copier or facsimile machine the user would pull the pull-tear strip 13 and open the toner package 11. Please note that the foam (not shown) could be placed so that it wipes the pull-tear strip 13 as it is pulled, acting as a check-valve.

In any of the described embodiments, single or multiple toner packages could be used, depending on the size of the toner hopper and/or the size and clearance of the rotating paddle 5 relative to the inside of the toner hopper 2. The toner cartridge manufacturer/remanufacturer and enduser both benefit by not having to touch dirty, dusty toner. By handling toner using the apparatus of this invention, the cartridge manufacturer/remanufacturer can definitely work in a much cleaner environment. The enduser has to pull a toner-saturated seal with all previous leakproof systems. In pulling the toner-saturated seal, some toner sticks to the seal. This toner stuck to the seal can get on the endusers' hands, clothes and all over the office environment. In the invention described, the toner cartridge will be leakproof, yet the enduser will not have to pull a toner-saturated seal.

Thus, the enduser will no longer have to encounter toner whatsoever. This has never been done before with any leakproof toner hopper shipping system.

It can also be beneficial to the remanufacturer. In the IBM 4019/4029 toner cartridge, manufactured by Lexmark Inc, the cartridge has no shipping seal. There is no slot for a seal. The toner cartridges leak when shipping. It is a very difficult problem both for the cartridge remanufacturer and the brand new cartridge manufacturer. As a result of this invention, even the unslotted IBM 4019 cartridge may be sealed with great reliability. Furthermore, with this invention a toner cartridge with no place for a shipping seal could become an intentional design and will have several advantages over other types of toner cartridges. A toner hopper may be designed with no slot for a toner seal, making conventional seals like stiff plastic cards, flexible plastic heat seals, adhesive seals and magnetic seals obsolete. Even if the old concept of "toner dams" does not become obsolete, the embodiments of this invention may be adapted to almost any "old style" toner hopper designed to use a dam seal to prevent toner leakage during shipping.

The invention of this application solves the problem of toner distribution in pre-weighed amounts to the toner cartridge manufacturer/remanufacturer, because it discloses a new packaging system for toner. Throw-away bottles and milk cartons that cost a lot and wind up in landfills may be avoided. This part of the invention will make it practical for an OEM or Original Equipment Manufacturer to design an entire toner cartridge around the toner package. The toner cartridge may be designed for remanufacturing, yet be made difficult for others to remanufacture. Remanufacturing competition may be minimized by using a toner hopper sealing system of this invention which is coherent with the handling of the toner. In other words, by using the simple toner hopper seal system of this invention, variations of it may be developed where a toner hopper is designed around this sealing system. Consequently, if a competing remanufacturer receives an empty hopper with no location to place a conventional "dam seal", the competitor may be prevented or at least discouraged from remanufacturing the cartridge. The competitor cannot remanufacture the toner cartridge if it can not be simply sealed. This device will not prevent the small local remanufacturer from remanufacturing cartridges because a shipping seal is only required when shipping the cartridge. However, the big mail-order remanufacturer who wishes to remanufacture a cartridge with a hopper of such a design will be prevented unless he has a license to use this invention or purchase the product thereof. This invention can in essence put a lock and key on the remanufacturability of a given new design cartridge on a shipping level. This can be very beneficial to the OEM. This is similar to protecting software from software pirates by making it not duplicable after installation.

Since minor changes and modifications varied to fit particular operating requirements and environments will be understood by those skilled in the art, the invention is not considered limited to the specific examples chosen for purposes of illustration, and includes all changes and modifications which do not constitute a departure from the true spirit and scope of this invention as claimed in the following claims and reasonable equivalents to the claimed elements.

What is claimed is:

1. A toner delivering means for providing toner to toner hoppers of toner cartridges used in printers, copiers and facsimile machines, said toner delivering means comprising a plastic bag filled with toner, said plastic bag having a pull-tear strip for releasing the toner.

2. A toner delivering means for providing toner to toner hoppers of toner cartridges used in printers, copiers and facsimile machines, said toner delivering means comprising a paper bag filled with toner, said paper bag having a pull-tear strip for releasing the toner.

3. A toner delivering means for providing toner to a toner hopper of a toner cartridge used in printers, copiers and facsimile machines, said toner delivering means comprising a balloon for containing said toner and a string or wire wrapped around a center of said balloon for releasing said toner from said balloon when said balloon is sealed in said toner hopper and said string or wire is activated.

4. A toner delivering means as in claim 3 wherein said balloon is attached to said toner hopper within said toner hopper, said toner hopper having an inner rotating paddle for preventing toner lumping, and said string or wire is attached to said paddle, whereby when said paddle is rotated upon operation of said toner cartridge said string or wire tightens around said center of said balloon, eventually tearing or breaking said balloon and causing toner to be equally distributed along the length of said toner hopper.

5. A toner delivering means as in claim 4 wherein there is slack in said string or wire between said paddle and said balloon so said balloon is not torn or broken until after an initial rotation period of said paddle upon operation of said toner cartridge.

6. A toner delivering means as in claim 3 wherein said toner hopper has an inner rotating paddle, said balloon is attached to said paddle and rotates with said paddle, and said string or wire is attached to said toner hopper, whereby when said paddle is rotated upon operation of said toner cartridge said string or wire tightens around said center of said balloon, eventually tearing or breaking said balloon and causing toner to be equally distributed along the length of said toner hopper.

7. A toner delivering means for providing toner to a toner hopper of a toner cartridge used in printers, copiers and facsimile machines, said toner delivering means comprising multiple toner container means for containing said toner and multiple toner release means for releasing said toner from said multiple toner container means and distributing toner along the length of the toner hopper when said multiple toner container means are sealed in said toner hopper and said multiple toner release means are activated.

8. A toner delivering means for providing toner to a toner hopper of a toner cartridge used in printers, copiers and facsimile machines, said toner delivering means comprising a package made of plastic, cellophane-like material for containing said toner and a pull-tear strip attached to said package for releasing said toner from said package when said package is sealed in said toner hopper and said pull-tear strip is activated.

9. A toner delivering means as in claim 8 wherein said package is attached to said toner hopper within said toner hopper, said toner hopper having a inner rotating paddle for preventing toner lumping, and said pull-tear strip is attached to said paddle, whereby when said paddle is rotated upon operation of said toner cartridge said paddle winds up said pull-tear strip and releases toner from said package into said toner hopper.

10. A toner delivering means as in claim 9 wherein said pull-tear strip extends along the length of said package so the entire said package is opened when said pull-tear strip is wound up by said paddle, whereby toner is evenly distributed along the length of said toner hopper.

11. A toner delivering means as in claim 9 wherein there is slack in said pull-tear strip between said paddle and said package whereby said package is not opened until after an initial rotation period of said paddle upon operation of said toner cartridge.

12. A toner delivering means as in claim 9 wherein there are multiple pull-tear strips attached along the length of said package, and each of said multiple pull-tear strips are attached to said paddle, whereby toner is evenly distributed along the length of said toner hopper when said pull-tear strips are activated.

13. A toner delivering means as in claim 8 wherein there are multiple packages and a pull-tear strip is attached to each of said multiple packages.

14. A toner delivering means an in claim 8 wherein said toner hopper has an inner rotating paddle for preventing toner lumping, said package is attached to said paddle such that said package rotates with said paddle, and said pull-tear strip is also attached to said toner hopper, whereby when said paddle is rotated upon operation of said toner cartridge said package is separated from said pull-tear strip and is opened, releasing toner along the length of said toner hopper.

15. A toner delivering means as in claim 14 wherein the attachment of said package to said paddle is secure enough such that said package continues to rotate with said paddle after releasing said toner, whereby said package is prevented from blocking the dispensing of toner from said toner hopper.

16. A toner delivering means as in claim 8 wherein said toner hopper has an opening above an expected toner level and said pull-tear strip extends through said opening, whereby said package may be opened from outside of said toner hopper when said package is sealed in said toner hopper.

* * * * *